US012467468B2

(12) United States Patent
Xu

(10) Patent No.: US 12,467,468 B2
(45) Date of Patent: Nov. 11, 2025

(54) LIGHT EMITTING FAN

(71) Applicant: Purple Cloud Development Pte. Ltd., Singapore (SG)

(72) Inventor: Shiman Xu, Singapore (SG)

(73) Assignee: Purple Cloud Development Pte. Ltd., Singapore (SG)

( * ) Notice: Subject to any disclaimer, the term of this patent is extended or adjusted under 35 U.S.C. 154(b) by 0 days.

(21) Appl. No.: 18/739,313

(22) Filed: Jun. 10, 2024

(65) Prior Publication Data

US 2024/0410382 A1 Dec. 12, 2024

(30) Foreign Application Priority Data

Jun. 9, 2023 (CN) ..... 202321477831.9

(51) Int. Cl.

| | |
|---|---|
| ***F04D 29/00*** | (2006.01) |
| ***F04D 19/00*** | (2006.01) |
| ***F04D 29/52*** | (2006.01) |
| ***F04D 29/66*** | (2006.01) |

(52) U.S. Cl.

CPC ..... *F04D 29/005* (2013.01); *F04D 19/002* (2013.01); *F04D 29/522* (2013.01); *F04D 29/668* (2013.01)

(58) Field of Classification Search

CPC .... F04D 29/005; F04D 29/522; F04D 29/668; F04D 29/646; F04D 19/002; F21V 33/0096; F21V 33/0088; F21V 33/0092

See application file for complete search history.

(56) References Cited

U.S. PATENT DOCUMENTS 5,407,324 A * 4/1995 Starnes, Jr. ..... F04D 25/0613 415/214.1
6,638,016 B1 * 10/2003 Mease ..... F04D 25/166 415/214.1
7,563,070 B2 * 7/2009 Lin ..... F04D 29/005 415/176
8,043,049 B2 * 10/2011 Chen ..... F04D 29/668 415/214.1

(Continued)

FOREIGN PATENT DOCUMENTS

CN 208605373 U * 3/2019 ..... F04D 19/002
CN 112196817 A * 1/2021

(Continued)

*Primary Examiner* — Courtney D Heinle
*Assistant Examiner* — Ryan C Clark
(74) *Attorney, Agent, or Firm* — MERCHANT & GOULD P.C.

(57) ABSTRACT

A light emitting fan may include a fan frame, a fan assembly, a first and a second light guide ring, a light emitting assembly, and a plurality of fixing assemblies. The fan frame includes a bottom plate, an inner annular side plate, an outer fan frame, and a plurality of anti-vibration mounts. The fan assembly is rotatably disposed on the bottom plate. The inner annular side plate, the first and the second light guide rings, and the light emitting assembly are disposed between the bottom plate and the outer fan frame. Each plurality of fixing assemblies includes a locking assembly, disposed on the first light guide ring, and a receiving assembly, disposed on the second light guide ring or the fan frame, and is configured to enable the first light guide ring to lock to the second light guide ring or the fan frame, via a pushing force.

20 Claims, 10 Drawing Sheets

(56) References Cited

U.S. PATENT DOCUMENTS

| | | | | |
|---|---|---|---|---|
| 9,777,918 | B1 * | 10/2017 | Wen | F21V 19/003 |
| 10,969,097 | B2 * | 4/2021 | Horng | F21V 3/0625 |
| 2002/0098086 | A1 * | 7/2002 | Orlowski | F04D 29/646 415/214.1 |
| 2002/0153787 | A1 * | 10/2002 | Hollenbeck | H02K 1/145 310/68 R |
| 2007/0231157 | A1 * | 10/2007 | Chuang | F04D 29/703 416/247 R |
| 2010/0040457 | A1 * | 2/2010 | Tsen | F04D 29/526 415/121.3 |
| 2013/0216372 | A1 * | 8/2013 | Wang | F04D 29/646 415/213.1 |
| 2016/0154164 | A1 * | 6/2016 | Lin | F24F 3/056 362/96 |
| 2016/0369809 | A1 * | 12/2016 | Richter | H05K 7/20136 |
| 2018/0017725 | A1 * | 1/2018 | Fang | F21V 19/003 |
| 2019/0029143 | A1 * | 1/2019 | Xie | F04D 25/0613 |
| 2019/0249862 | A1 * | 8/2019 | Fan | F21V 17/12 |
| 2019/0331122 | A1 * | 10/2019 | Chen | F04D 19/005 |
| 2019/0346130 | A1 * | 11/2019 | Lin | H05K 1/0284 |
| 2020/0224674 | A1 * | 7/2020 | Yang | F04D 25/166 |
| 2021/0199128 | A1 * | 7/2021 | Xu | F04D 29/601 |
| 2021/0222868 | A1 * | 7/2021 | Xu | F04D 29/646 |
| 2022/0049706 | A1 * | 2/2022 | Fan | F21V 33/0096 |

FOREIGN PATENT DOCUMENTS

| | | | | |
|---|---|---|---|---|
| CN | 114076111 | A * | 2/2022 | F04D 25/08 |
| WO | WO-2020191944 | A1 * | 10/2020 | |

* cited by examiner

LIGHT EMITTING FAN

RELATED APPLICATIONS

This US application claims the benefit of priority to China application no. 202321477831.9, filed on Jun. 9, 2023, of which is incorporated herein by reference in its entirety.

TECHNICAL FIELD

The present disclosure relates to heat-transfer components and assemblies, and more particularly, but not limited to, light emitting fans.

BACKGROUND OF THE INVENTION

With increasing processing speed and performance of electronic devices, the amount of heat generated during operation of an electronic device has increased. The heat generation increases the temperature of the electronic device and, if the heat cannot be dissipated effectively, the reliability and performance of the electronic device is reduced. To prevent overheating of an electronic device, cooling apparatuses such as fans are used to efficiently dissipate the heat generated by the electronic device and, thereby ensure the standard operation of the electronic device.

In the case of fans or other rotating cooling apparatuses, lighting such as light-emitting diode (LED) lights, LED strip lights, or LED bar lights are assembled to the fans for illumination of the fans and electronic devices. However, to achieve illumination in different directions of the fan or via different surface areas of the fan, multiple parts and LED light sources are added, making assembly time-consuming, and maintenance, repair, and parts replacement inconvenient and inefficient.

SUMMARY OF THE INVENTION

The present disclosure provides a light emitting fan with illumination in different direction and decreased parts.

In some aspects, the techniques described herein relate to a light emitting fan, including a fan frame, a fan assembly, a first and a second light guide ring, a light emitting assembly, and a plurality of fixing assemblies. The fan frame includes a bottom plate, an inner annular side plate, an outer fan frame, and a plurality of anti-vibration mounts. The inner annular side plate is coupled to the bottom plate along an inner circumferential edge thereof and defines a fan space. The fan assembly is rotatably disposed on the bottom plate and in the fan space. The inner annular side plate is disposed between the bottom plate and the outer fan frame. The first light guide ring includes a first annular mount surface and a first annular illumination surface and the second light guide ring includes a second annular mount surface and a second annular illumination surface. The second annular mount surface is disposed abutting the first annular mount surface and the first light guide ring and the second light guide ring are disposed between the inner annular side plate and the outer fan frame. The light emitting assembly is disposed between the first light guide ring and the second light guide ring and the outer fan frame. The light emitting assembly is configured to emit light through the first annular illumination surface and the second annular illumination surface. Each plurality of anti-vibration mounts extends from respective opposing corners of the outer fan frame and includes a through hole cut out. Each plurality of fixing assemblies includes a locking assembly and a receiving assembly. The locking assembly is disposed on the first light guide ring and the receiving assembly is disposed on at least one of the second light guide ring or the fan frame. The plurality of fixing assemblies is configured to enable the first light guide ring to lock to at least one of the second light guide ring or the fan frame, through the through hole cut out, via a pushing force.

In some aspects, the techniques described herein relate to a light emitting fan, wherein the bottom plate includes a shaft support and the fan assembly includes a hub, a shaft, and a plurality of blades. The shaft support is disposed at a center of the bottom plate, the shaft extends centrally from the hub, and the plurality of blades radially extend from the hub. The fan assembly is disposed on the bottom plate via the shaft and shaft support.

In some aspects, the techniques described herein relate to a light emitting fan, wherein the light emitting assembly and the outer fan frame define a cavity, and wherein the light emitting assembly includes a circuit board and a plurality of light sources. The plurality of light sources is disposed on the circuit board and configured to emit light that is directed toward the first annular illumination surface and directed toward the second annular illumination surface via the cavity.

In some aspects, the techniques described herein relate to a light emitting fan, wherein when the receiving assembly is disposed on the second light guide ring, the fan frame further includes a plurality of mount stops and the second light guide ring further includes a plurality of mount slots. The inner annular side plate is coupled to the outer fan frame via the plurality of mount stops. The inner annular side plate and the outer fan frame define a mounting space, each plurality of mount slots of the second light guide ring abut each plurality of mount stops.

In some aspects, the techniques described herein relate to a light emitting fan, wherein when the receiving assembly is disposed on the second light guide ring, the first light guide ring further includes an inner annular ledge and a first inner annular sidewall. The inner annular ledge is disposed between the first annular illumination surface and the first annular mount surface. The first inner annular sidewall is between the inner annular ledge and the first annular mount surface. The inner annular ledge abuts a plate mounting surface of the inner annular side plate and the first inner annular sidewall abuts an outer wall of the inner annular side plate.

In some aspects, the techniques described herein relate to a light emitting fan, wherein the locking assembly includes a first base, a deflection part, and a first retaining part. The deflection part protrudes from the first base and the first retaining part protrudes from an end of the deflection part opposite an end protruding from the first base. The receiving assembly includes a second base and a receiving part. The receiving part protrudes from the second base and the receiving part includes a locking cavity. When the first light guide ring is locked to at least one of the second light guide ring or the fan frame, the first retaining part is disposed in the locking cavity abutting the receiving part.

In some aspects, the techniques described herein relate to a light emitting fan, wherein the first base includes a first outer side and a first access cut out. The first outer side is opposite a side with the deflection part and the first access cut out is configured to access the deflection part from the first outer side.

In some aspects, the techniques described herein relate to a light emitting fan, wherein the second base includes a second outer side and a second access cut out. The second outer side is opposite a side with the receiving part and the second access cut out is configured to access the first retaining part from the second outer side.

In some aspects, the techniques described herein relate to a light emitting fan, wherein each plurality of anti-vibration mounts further includes a first depression on a first side and a second depression on a second side. The second side faces a direction that is opposite a direction the first side is facing. The first depression includes a pair of first opposing positioners and the pair of first opposing positioners protrude in the first depression. The second depression includes a pair of second opposing positioners and the pair of second opposing positioners protrude in the second depression. A first opening of the through hole cut out is between the pair of first opposing positioners and a second opening of the through hole cut out is between the pair of second opposing positioners.

In some aspects, the techniques described herein relate to a light emitting fan, wherein each plurality of anti-vibration mounts further includes a through hole. The through hole is configured to enable fasteners to be fastened therethrough for mounting of the light emitting fan. The through hole cut out is between the through hole and the outer fan frame. The through hole includes a first protruding part and a second protruding part. A first height of the first protruding part is greater than a depth of the first depression. A second height of the second protruding part is greater than a depth of the second depression.

In some aspects, the techniques described herein relate to a light emitting fan, wherein the first base includes a pair of first opposing positioner cut outs and a first protruding part cut outs, and wherein the second base includes a pair of second opposing positioner cut outs and a second protruding part cut out. The first base is disposed in the first depression and abuts the pair of first opposing positioner cut outs and the first protruding part. The second base is disposed in the second depression and abuts the pair of first opposing positioner cut outs and the first protruding part.

In some aspects, the techniques described herein relate to a light emitting fan, further including a plurality of first elastic covers and a plurality of second elastic covers. Each plurality of first elastic covers is disposed in the first depression and abuts the first protruding part. Each plurality of first elastic covers is configured to cover the locking assembly and the pair of first opposing positioners. Each plurality of second elastic covers is disposed in the second depression and abuts the second protruding part. Each plurality of second elastic covers is configured to cover the receiving assembly and the pair of second opposing positioners.

In some aspects, the techniques described herein relate to a light emitting fan, wherein each plurality of first elastic covers includes opaque material, and wherein each plurality of second elastic covers includes opaque material.

In some aspects, the techniques described herein relate to a light emitting fan, wherein when the receiving assembly is disposed on the fan frame, the second annular mount surface disposed abutting the first annular mount surface are integrally connected and form a modified annular side plate. The modified annular side plate includes an inner modified surface and an outer modified surface. The inner annular side plate includes a plurality of second retaining parts and the modified annular side plate includes a plurality of second receiving through holes disposed through the inner modified surface. The inner annular side plate is coupled to the outer fan frame via the plurality of second retaining parts disposed through the plurality of second receiving through holes and the plurality of fixing assemblies.

In some aspects, the techniques described herein relate to a light emitting fan, wherein when the receiving assembly is disposed on the fan frame, the circuit board is disposed abutting the outer modified surface. The plurality of light sources is between the first annular illumination surface and the second annular illumination surface.

BRIEF DESCRIPTION OF DRAWINGS

Unless specified otherwise, the accompanying drawings illustrate aspects of the innovative subject matter described herein. Referring to the drawings, wherein like reference numerals indicate similar parts throughout the several views, several examples of light emitting fans incorporating aspects of the presently disclosed principles are illustrated by way of example, and not by way of limitation.

DETAILED DESCRIPTION

The following describes various principles related to components and assemblies for electronic devices cooling by way of reference to specific examples of light emitting fans, including specific arrangements and examples of fan frames and first and second light guide rings embodying innovative concepts. More particularly, but not exclusively, such innovative principles are described in relation to selected examples of light emitting assemblies emitting light in different directions and fixing assemblies locking components of the light emitting fans to one another via a pushing force, and well-known functions or constructions are not described in detail for purposes of succinctness and clarity. Nonetheless, one or more of the disclosed principles can be incorporated in various other embodiments of light emitting assemblies emitting light in different directions and fixing assemblies locking components of the light emitting fans to one another via a pushing force to achieve any of a variety of desired outcomes, characteristics, and/or performance criteria.

Thus, light emitting assemblies and fixing assemblies having attributes that are different from those specific examples discussed herein can embody one or more of the innovative principles, and can be used in applications not described herein in detail. Accordingly, embodiments of light emitting assemblies and fixing assemblies not described herein in detail also fall within the scope of this disclosure, as will be appreciated by those of ordinary skill in the relevant art following a review of this disclosure.

Example embodiments as disclosed herein are directed to light emitting fans that can be used in cooling systems to dissipate high heat loads. The cooling system may be configured on a chassis, within a chassis, or as part of an electronics system that includes heat producing electronic components to be cooled. The cooling system includes at least one light emitting fan. The light emitting fan may be coupled to the chassis via a fastener (e.g., bolts, screws, an adhesive material, etc.), transporting air to heat producing electronic components to be cooled and/or to an outside of the chassis or electronics system. The cooling system may further comprise one or more liquid-based cooling loops. The light emitting fans may be coupled to the back end of a radiator via a fastener at structural portions of the radiator, transporting air through the radiator to an air plenum or to the outside of the chassis or electronics system.

Figure 1A:
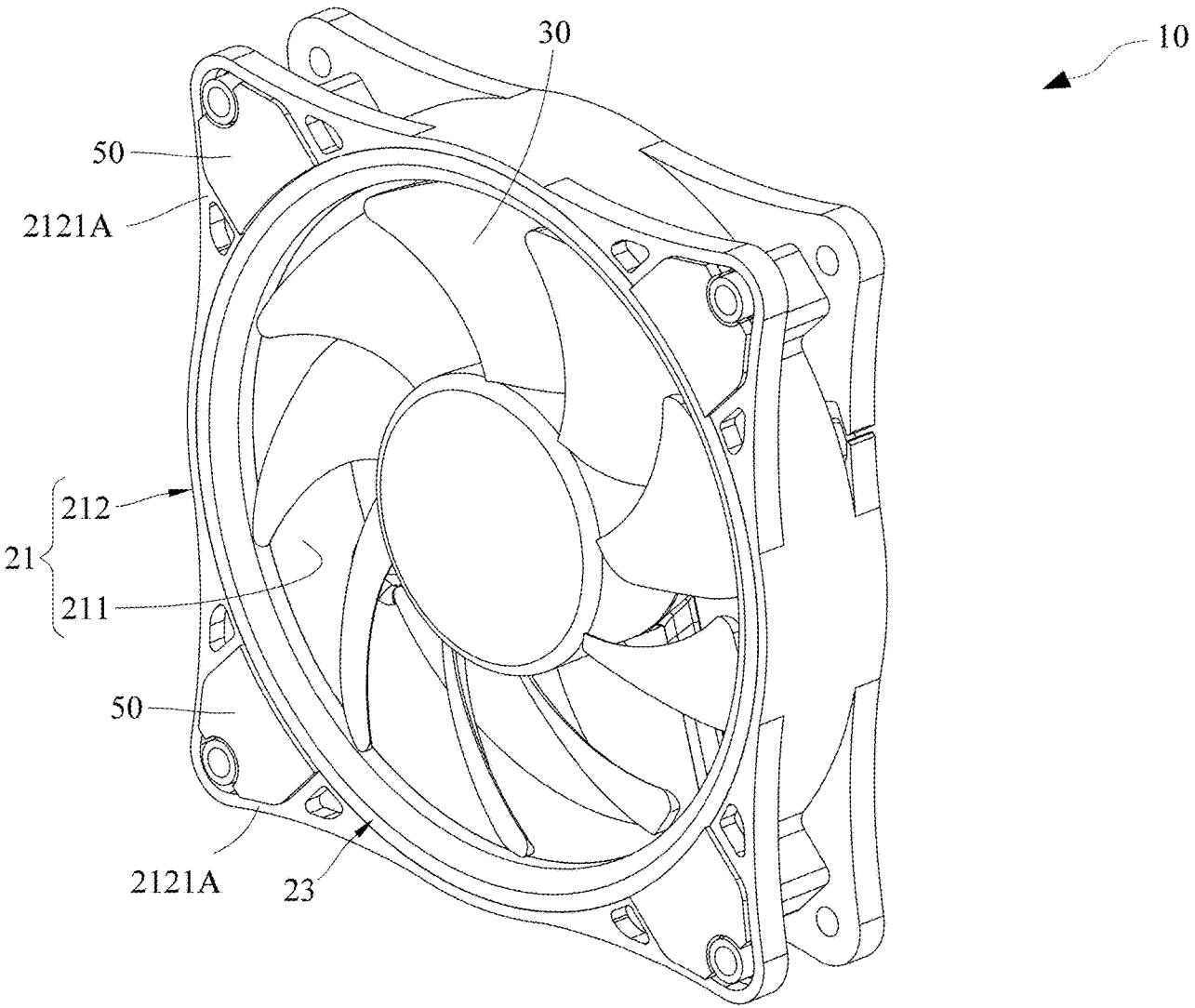
FIG. 1A illustrates a perspective view of a light emitting fan, in accordance with various embodiments of the present disclosure.
Figure 1B:
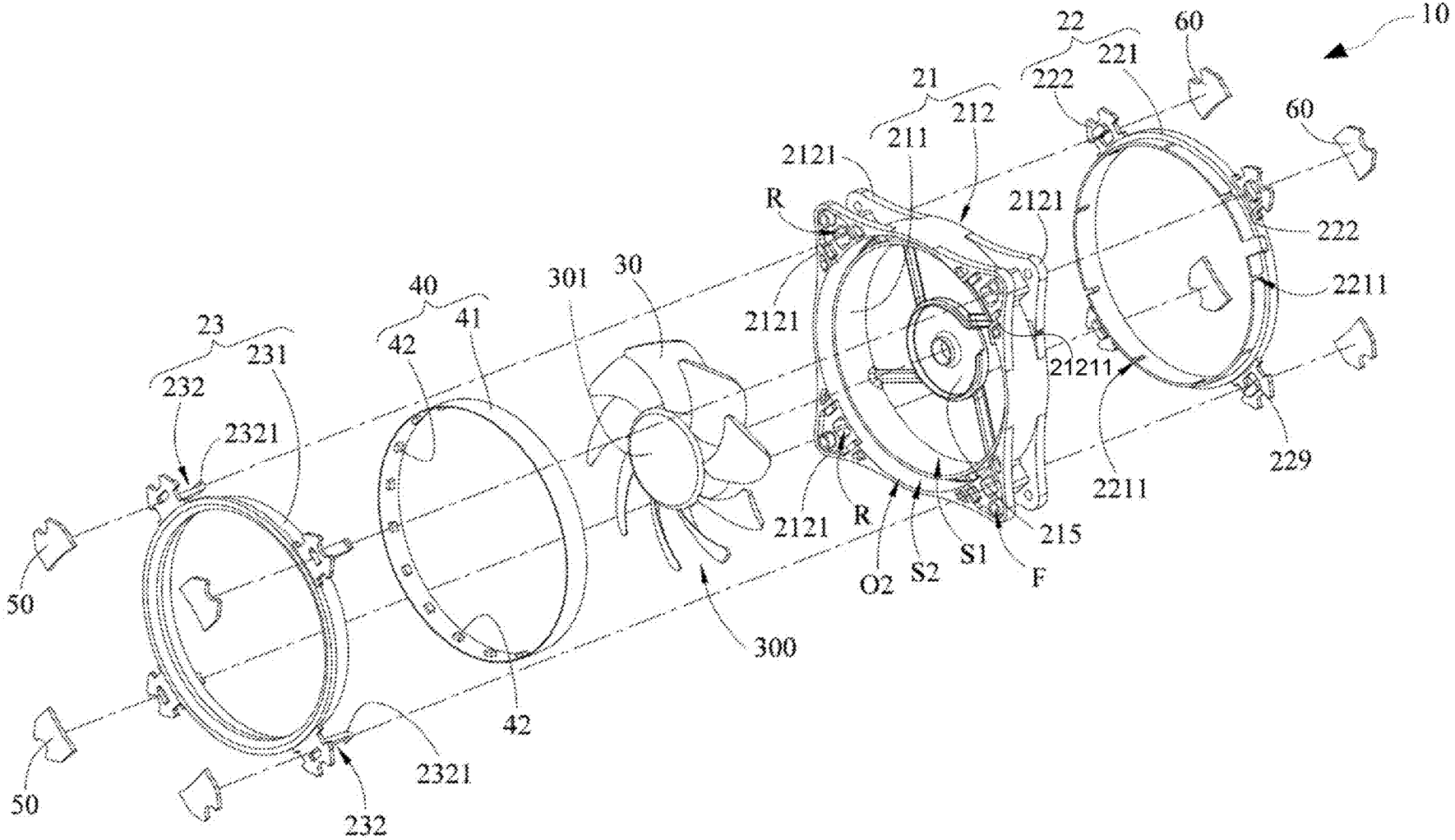
FIG. 1B illustrates an exploded view of the light emitting fan of FIG. 1A, in accordance with various embodiments of the present disclosure.
Figure 1C:
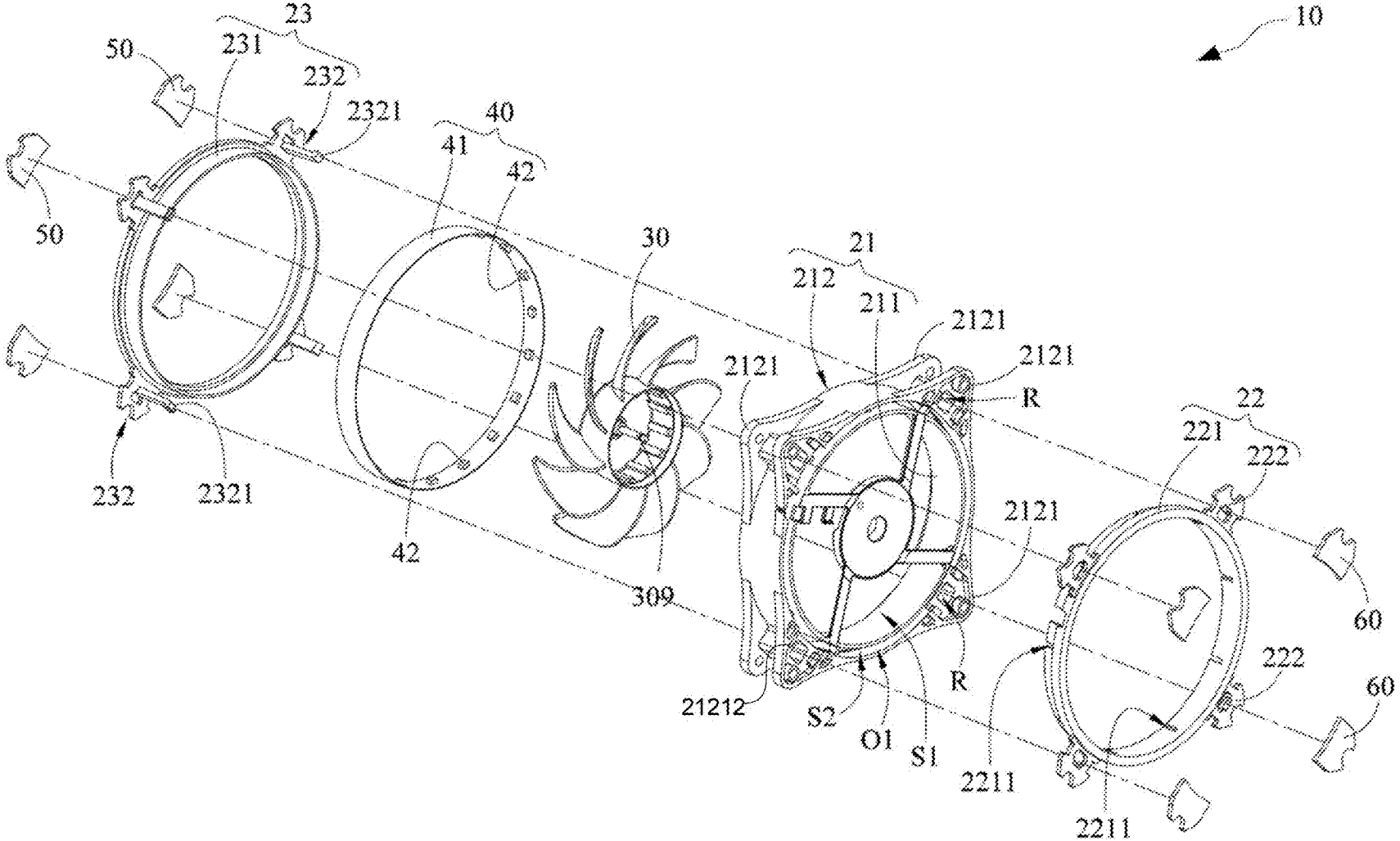
FIG. 1C illustrates another exploded view of the light emitting fan of FIG. 1A, in accordance with various embodiments of the present disclosure.
Figure 2:
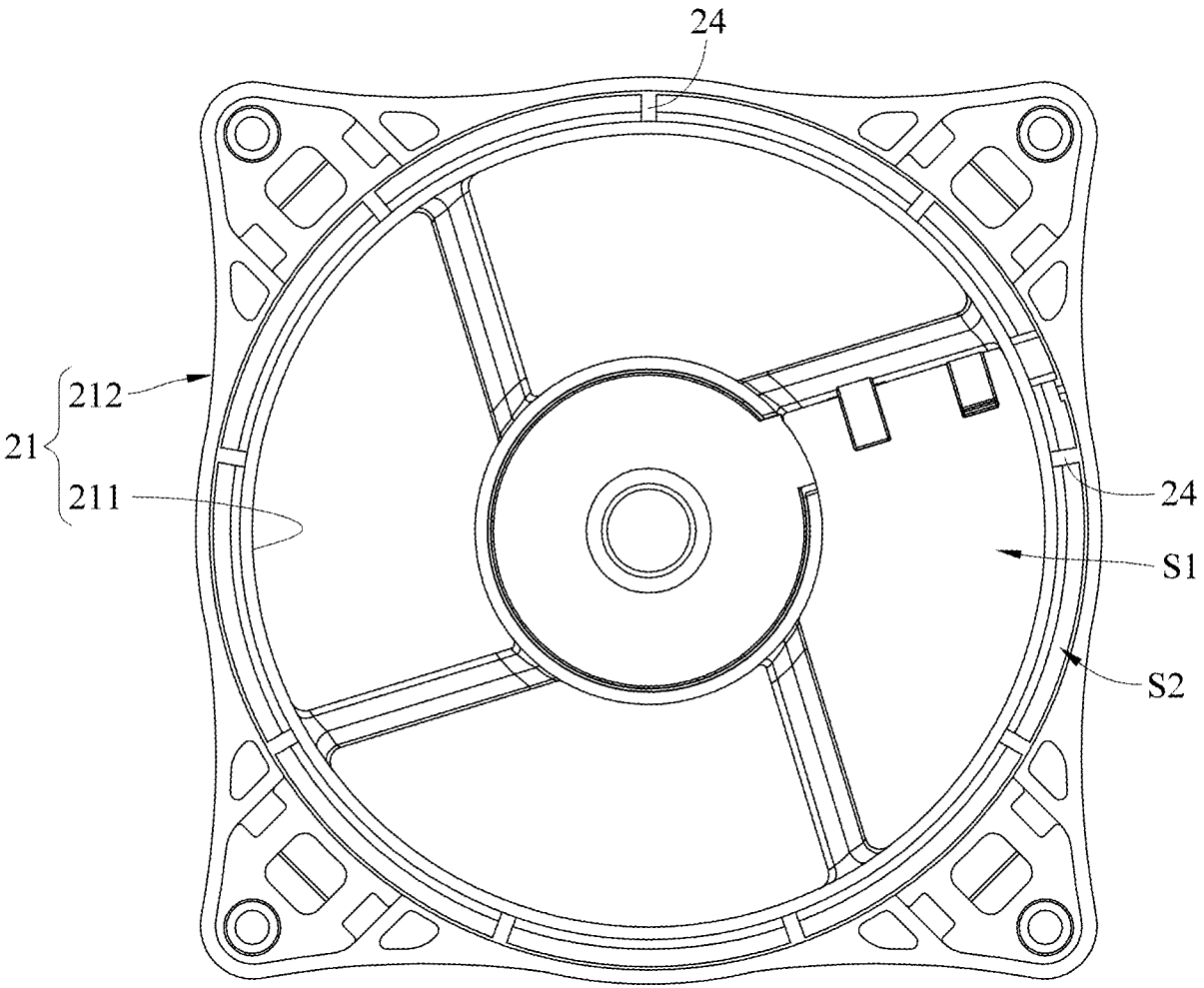
FIG. 2 illustrates a perspective view of a fan frame of the light emitting fan of FIG. 1A, in accordance with various embodiments of the present disclosure.
Figure 3:
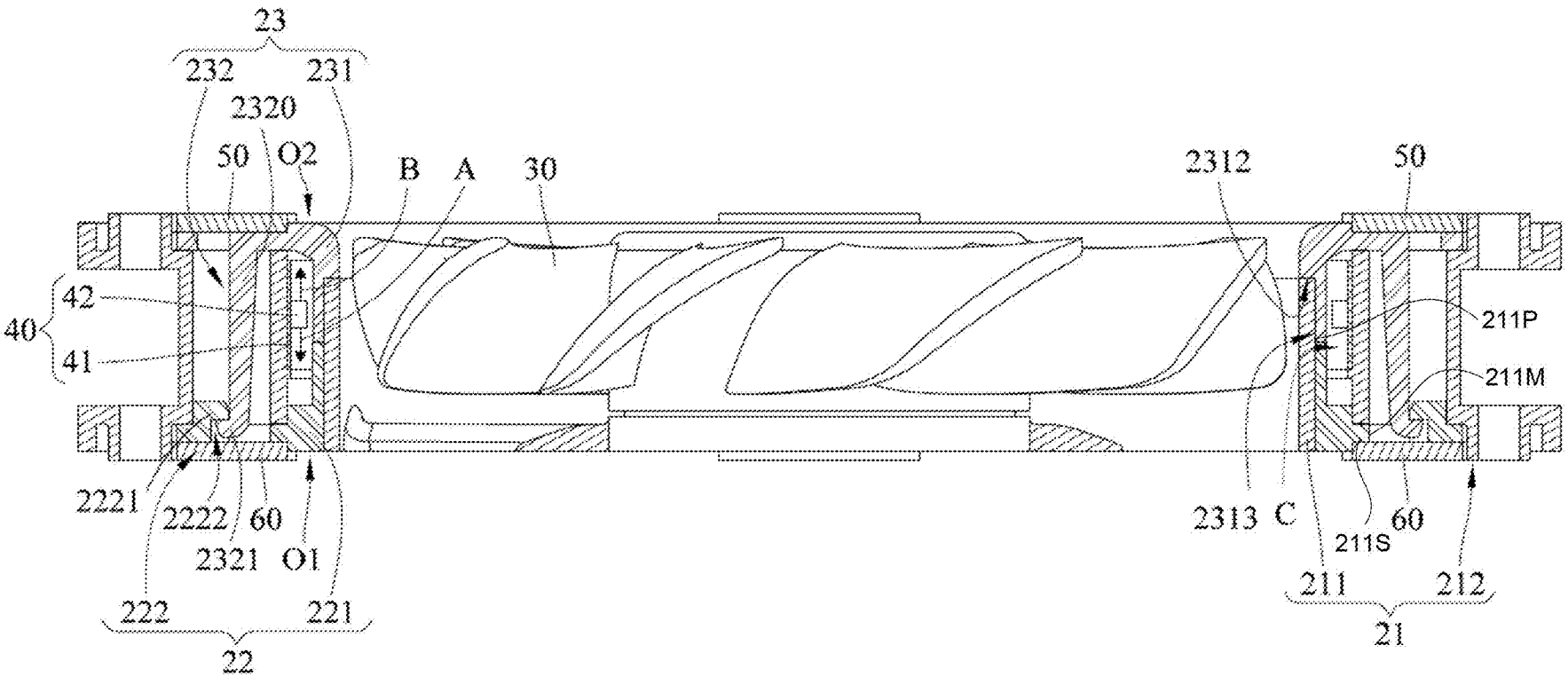
FIG. 3 illustrates a side, cross-sectional view of the light emitting fan of FIG. 1A, in accordance with various embodiments of the present disclosure.

FIGS. 1A to 3 illustrate a light emitting fan 10, in accordance with various embodiments of the present disclosure. In some embodiments, the light emitting fan 10 includes a fan frame 21, a fan assembly 300, a first and a second light guide ring 22 23, 22, a light emitting assembly 40, and a plurality of fixing assemblies 232, 222. The fan frame 21 includes a bottom plate 215, an inner annular side plate 211, an outer fan frame 21, and a plurality of anti-vibration mounts 2121. The inner annular side plate 211 is coupled to the bottom plate 215 along an inner circumferential edge thereof and defines a fan space S1. The bottom plate 215 can be circular shaped and the fan assembly 300 is rotatably disposed on the bottom plate 215 and in the fan space S1. A geometric shape of the fan assembly 300 corresponds to a geometric shape of the fan space S1. The inner annular side plate 211 is disposed between the bottom plate 215 and the outer fan frame 21. The first light guide ring 23 includes a first annular mount surface and a first annular illumination surface 231 and the second light guide ring 22 includes a second annular mount surface and a second annular illumination surface 221. The second annular mount surface is disposed abutting the first annular mount surface and the first light guide ring 23 and the second light guide ring 22 are disposed between the inner annular side plate 211 and the outer fan frame 21. The light emitting assembly 40 is disposed between the first light guide ring 23 and the second light guide ring 22 and the outer fan frame 21. The light emitting assembly 40 is configured to emit light through the first annular illumination surface 231 and the second annular illumination surface 221. Each plurality of anti-vibration mounts 2121 extends from respective opposing corners of the outer fan frame 21 and includes a through hole cut out R. Each plurality of fixing assemblies 232, 222 includes a locking assembly 232 and a receiving assembly 222. The locking assembly 232 is disposed on the first light guide ring 23 and the receiving assembly 222 is disposed on at least one of the second light guide ring 22 or the fan frame 21. The plurality of fixing assemblies 232, 222 is configured to enable the first light guide ring 23 to lock to at least one of the second light guide ring 22 or the fan frame 21, through the through hole cut out R, via a pushing force.

In some embodiments, wherein the bottom plate 215 includes a shaft support and the fan assembly 300 includes a hub 301, a shaft 309, and a plurality of blades 30. The shaft support is disposed at a center of the bottom plate 215, the shaft 309 extends centrally from the hub 301, and the plurality of blades 30 radially extend from the hub 301. The fan assembly 300 is disposed on the bottom plate 215 via the shaft 309 and shaft support.

In some embodiments, wherein the light emitting assembly 40 and the outer fan frame 21 define a cavity C, and wherein the light emitting assembly 40 includes a circuit board 41 and a plurality of light sources 42. The plurality of light sources 42 is disposed on the circuit board 41 and the circuit board 41 receives power to drive the plurality of light sources 42. The plurality of light sources 42 is configured to emit light that is directed toward the first annular illumination surface 231 and directed toward the second annular illumination surface 221 via the cavity C. A direction of light emitted from the second annular illumination surface 221 to an exterior of the light emitting fan is opposite a direction of light emitted from the first annular illumination surface 231 to an opposing exterior of the light emitting fan.

In some embodiments, wherein when the receiving assembly 222 is disposed on the second light guide ring 22, the fan frame 21 further includes a plurality of mount stops 211S. The inner annular side plate 211 is coupled to the outer fan frame 21 via the plurality of mount stops 211S. The plurality of mount stops 211S can be rectangular shaped. The inner annular side plate 211 and the outer fan frame 21 define a mounting space 211M, each plurality of mount slots of the second light guide ring 22 abut each plurality of mount stops 211S.

In some embodiments, wherein when the receiving assembly 222 is disposed on the second light guide ring 22, the first light guide ring 23 further includes an inner annular ledge and a first inner annular sidewall. The inner annular ledge 2312 is disposed between the first annular illumination surface 231 and the first annular mount surface. The first inner annular sidewall 2313 is between the inner annular ledge 2312 and the first annular mount surface. The inner annular ledge 2312 abuts a plate mounting surface 211P of the inner annular side plate 211 and the first inner annular sidewall 2313 abuts an outer wall of the inner annular side plate 211.

In some embodiments, wherein the locking assembly 232 includes a first base, a deflection part 2320, and a first retaining part 2321. The deflection part 2320 protrudes from the first base and the first retaining part 2321 protrudes from an end of the deflection part 2320 opposite an end protruding from the first base. The receiving assembly 222 includes a second base and a receiving part 2221. The receiving part 2221 protrudes from the second base and the receiving part 2221 includes a locking cavity 2222. When the first light guide ring 23 is locked to at least one of the second light guide ring 22 or the fan frame 21, the first retaining part 2321 is disposed in the locking cavity 2222 abutting the receiving part 2221.

In some embodiments, wherein the first base includes a first outer side and a first access cut out 239. The first outer side is opposite a side with the deflection part 2320 and the first access cut out 239 is configured to access the deflection part 2320 from the first outer side.

In some embodiments, wherein the second base includes a second outer side and a second access cut out 229. The second outer side is opposite a side with the receiving part 2221 and the second access cut out 229 is configured to access the first retaining part 2321 from the second outer side.

In some embodiments, wherein each plurality of anti-vibration mounts 2121 further includes a first depression on a first side and a second depression on a second side. The second side faces a direction that is opposite a direction the first side is facing. The first depression includes a pair of first opposing positioners 21211 and the pair of first opposing positioners 21211 protrude in the first depression. The second depression includes a pair of second opposing positioners 21212 and the pair of second opposing positioners 21212 protrude in the second depression. A first opening of the through hole cut out R is between the pair of first opposing positioners and a second opening of the through hole cut out R is between the pair of second opposing positioners.

In some embodiments, wherein each plurality of anti-vibration mounts 2121 further includes a through hole. The through hole is configured to enable fasteners to be fastened therethrough for mounting of the light emitting fan 10. The through hole cut out R is between the through hole and the outer fan frame 21. The through hole includes a first protruding part and a second protruding part. A first height of the first protruding part is greater than a depth of the first depression. A second height of the second protruding part is greater than a depth of the second depression.

In some embodiments, wherein the first base includes a pair of first opposing positioner cut outs and a first protruding part cut outs, and wherein the second base includes a pair of second opposing positioner cut outs and a second protruding part cut out. The first base is disposed in the first depression and abuts the pair of first opposing positioner cut outs and the first protruding part. The second base is disposed in the second depression and abuts the pair of first opposing positioner cut outs and the first protruding part.

In some embodiments, further including a plurality of first elastic covers 50 and a plurality of second elastic covers 60. Each plurality of first elastic covers 50 is disposed in the first depression and abuts the first protruding part. Each plurality of first elastic covers 50 is configured to cover the locking assembly 232 and the pair of first opposing positioners. Each plurality of second elastic covers 60 is disposed in the second depression and abuts the second protruding part. Each plurality of second elastic covers 60 is configured to cover the receiving assembly 222 and the pair of second opposing positioners.

In some embodiments, wherein each plurality of first elastic covers 50 includes opaque material, and wherein each plurality of second elastic covers 60 includes opaque material.

Figure 4A:
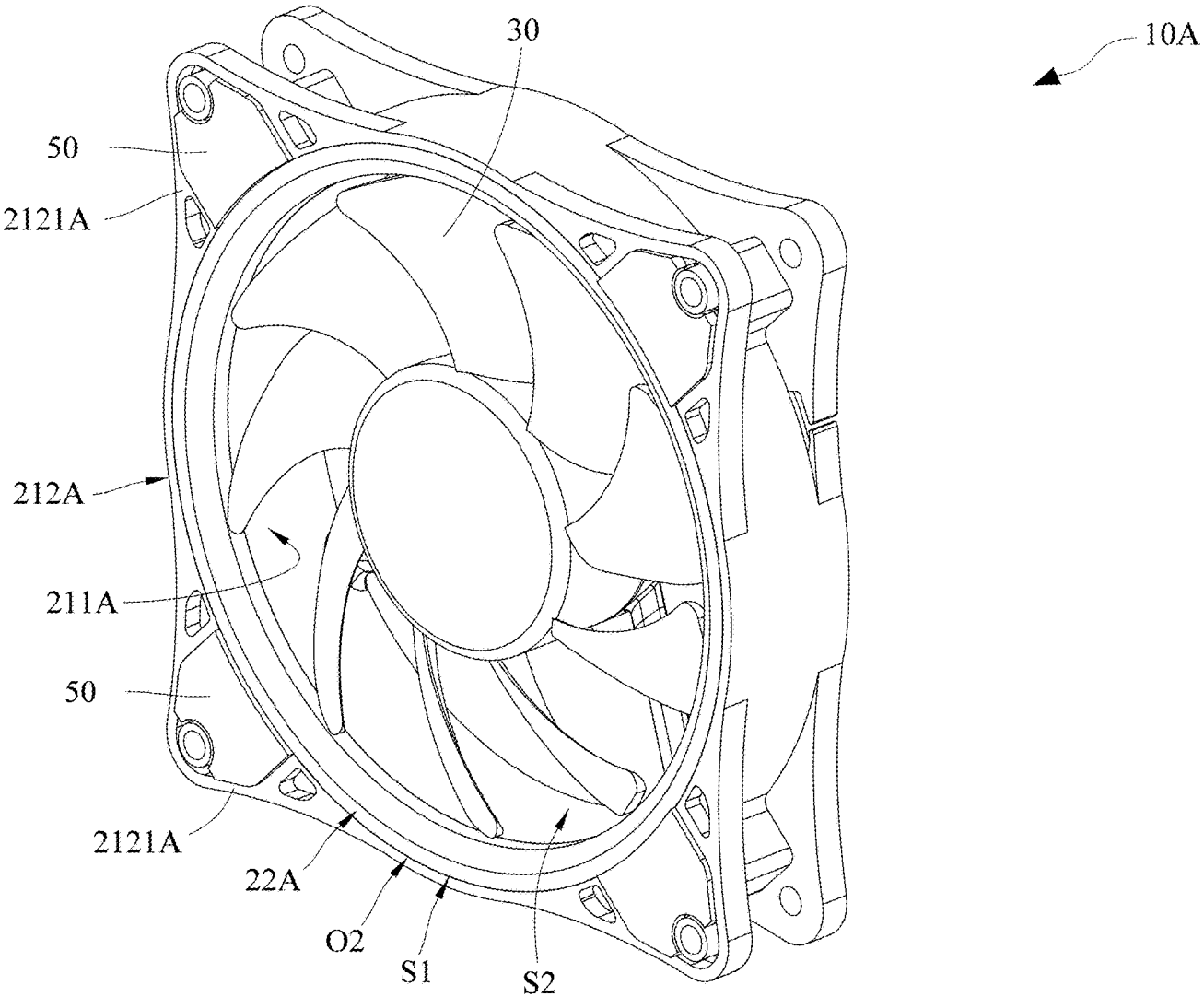
FIG. 4A illustrates a perspective view of another light emitting fan, in accordance with various embodiments of the present disclosure.
Figure 4B:
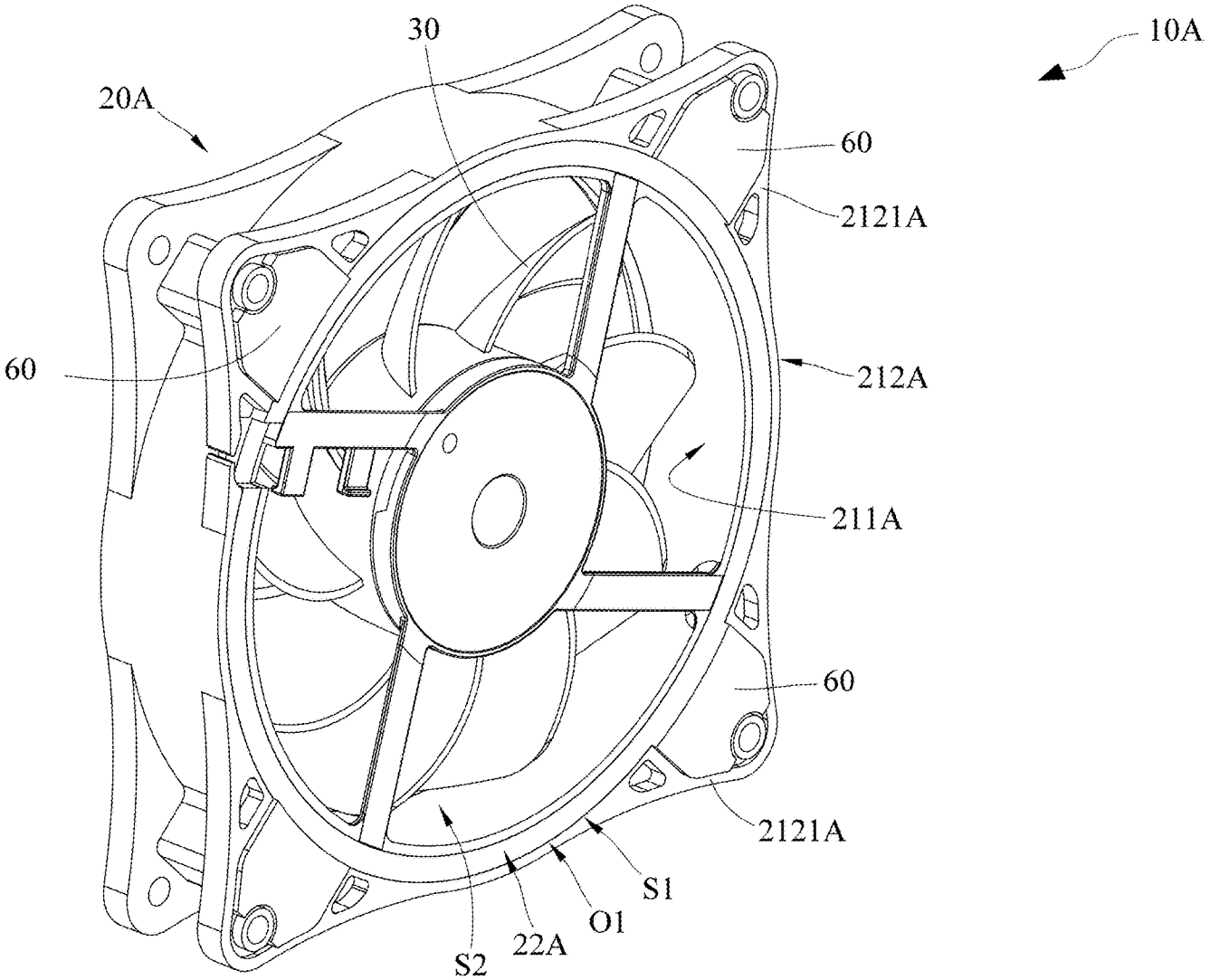
FIG. 4B illustrates another perspective view of another light emitting fan, in accordance with various embodiments of the present disclosure.
Figure 4C:
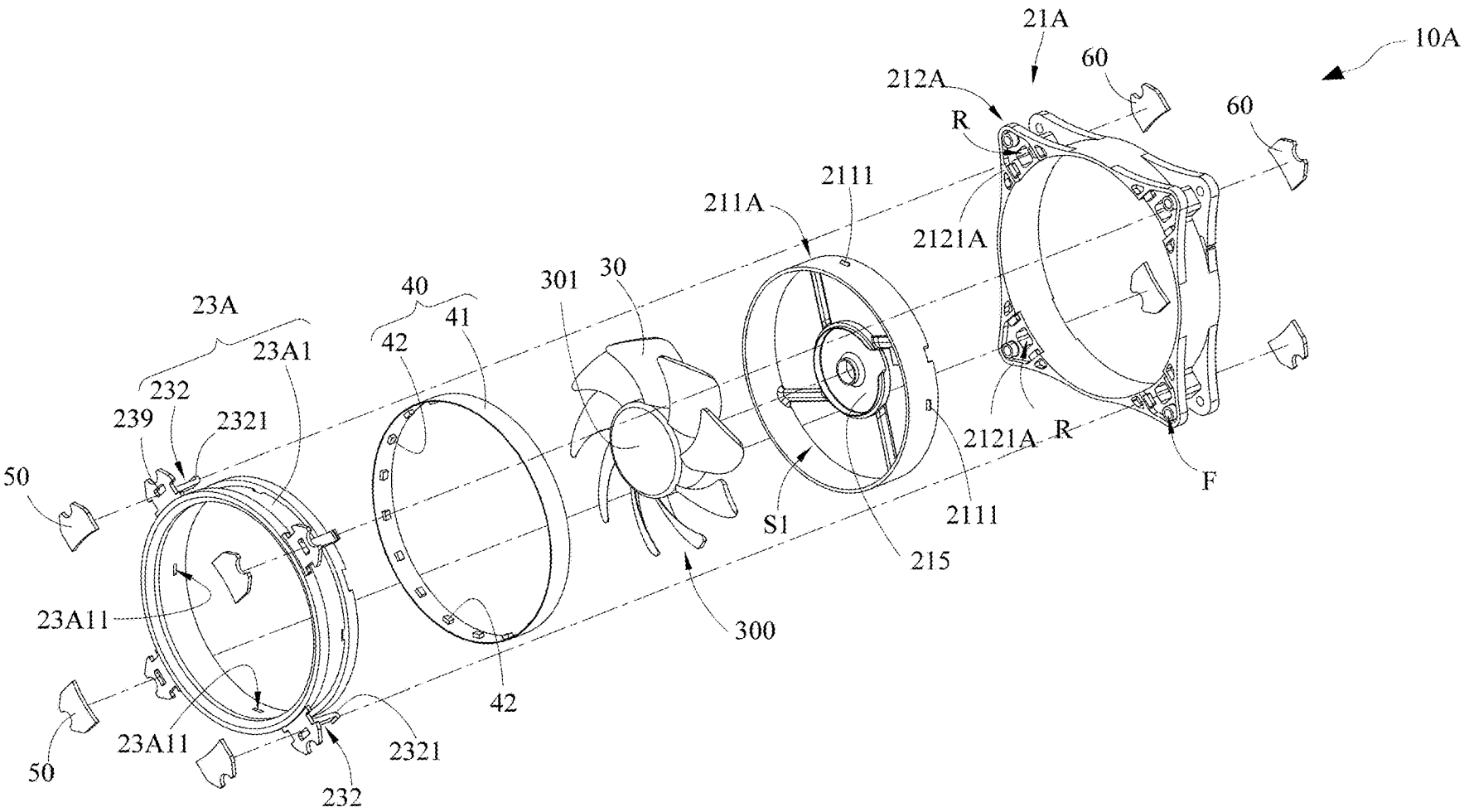
FIG. 4C illustrates an exploded view of the another light emitting fan of FIG. 4A, in accordance with various embodiments of the present disclosure.
Figure 5:
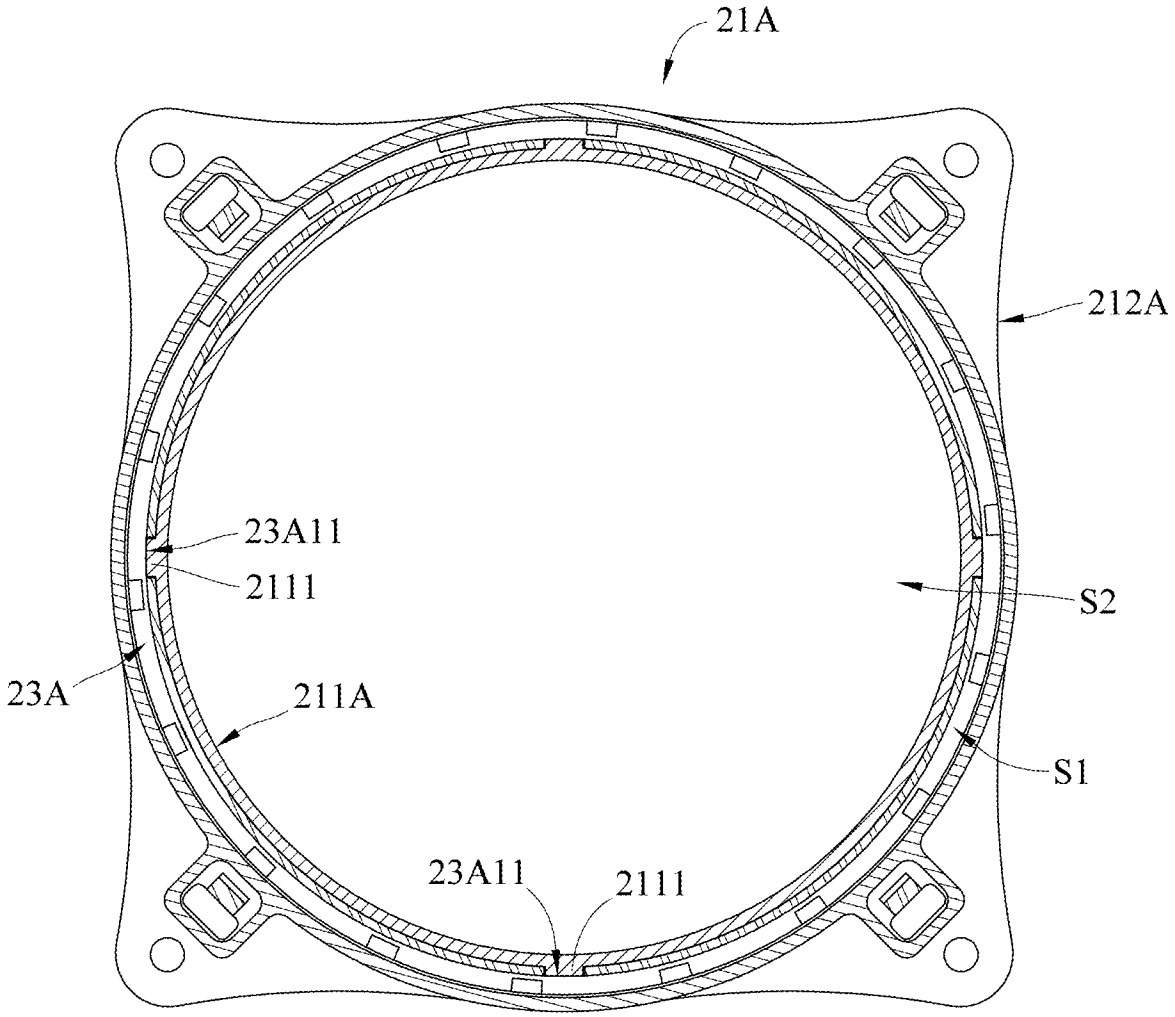
FIG. 5 illustrates a cross-sectional view of an inner annular side plate and modified annular side plate of the another light emitting fan of FIG. 4A, in accordance with various embodiments of the present disclosure.
Figure 6:
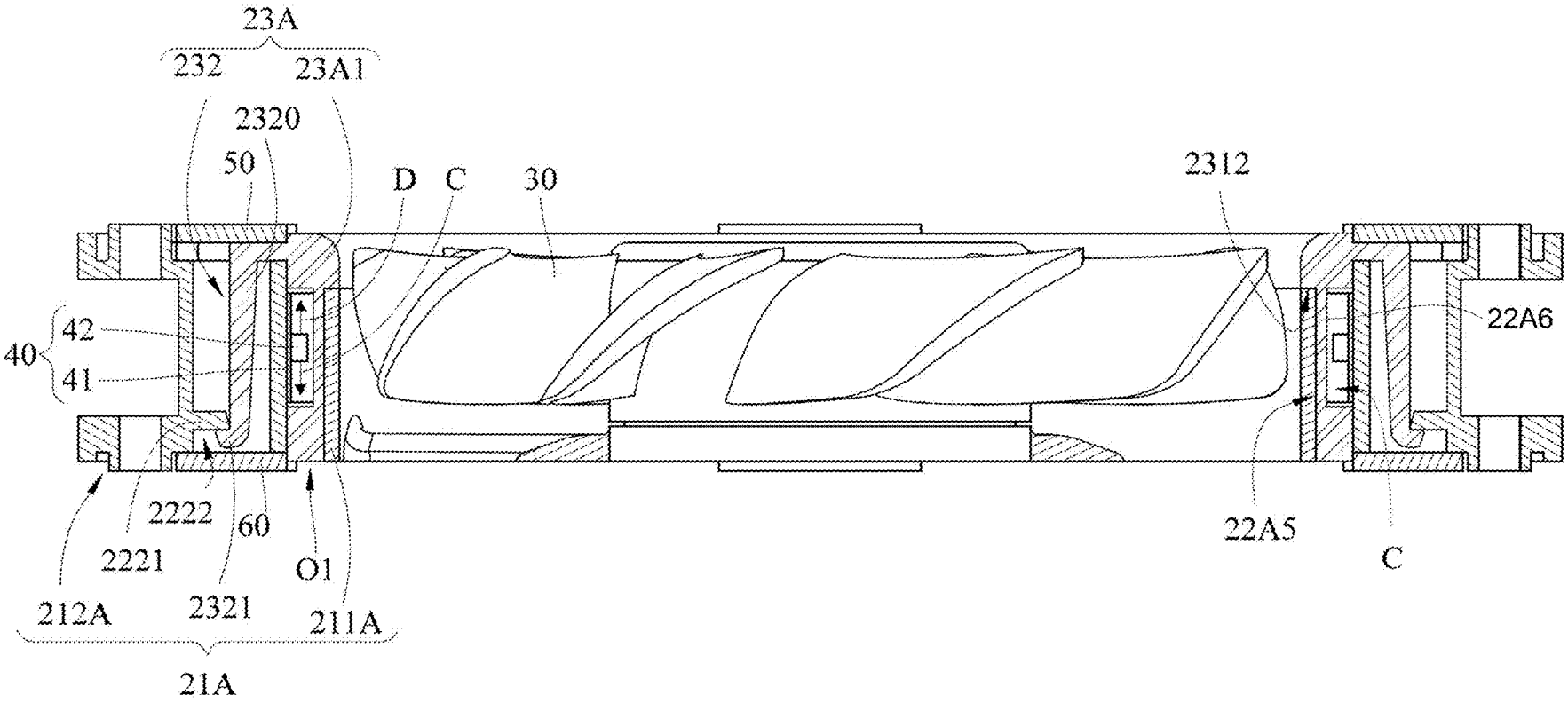
FIG. 6 illustrates a side, cross-sectional view of the another light emitting fan of FIG. 4A, in accordance with various embodiments of the present disclosure.

FIGS. 4A to 6 illustrate another light emitting fan 10A, in accordance with various embodiments of the present disclosure. The another light emitting fan 10A may be similar in some respects to the light emitting fan 10 of FIGS. 1A to 3, and therefore may be best understood with reference thereto where like numerals designate like components not described again in detail. In some embodiments, wherein when the receiving assembly 222 is disposed on the fan frame 21, the second annular mount surface disposed abutting the first annular mount surface are integrally connected and form a second annular side plate 23A1. The second annular side plate 23A1 includes an inner surface 22A5 and an outer surface 22A6. The inner annular side plate 211 includes a plurality of second retaining parts and the second annular side plate 23A1 includes a plurality of second receiving through holes disposed through the inner surface 22A5. The inner annular side plate 211 is coupled to the outer fan frame 21 via the plurality of second retaining parts disposed through the plurality of second receiving through holes and the plurality of fixing assemblies 232, 222.

In some embodiments, wherein when the receiving assembly 222 is disposed on the fan frame 21, the circuit board 41 is disposed abutting the outer surface 22A6. The plurality of light sources 42 is between the first annular illumination surface 231 and the second annular illumination surface 221.

Illumination of the light emitting fan 10/10A of the present disclosure is in different directions and parts of the light emitting fan for assembly is decreased. The cavity formed by the light emitting assembly 40 and the outer fan frame 21 enable the plurality of light sources to emit light that is directed toward the first annular illumination surface 231 and directed toward the second annular illumination surface 221 via the cavity, whereby the direction of light emitted from the second annular illumination surface 221 to an exterior of the light emitting fan is opposite a direction of light emitted from the first annular illumination surface 231 to an opposing exterior of the light emitting fan. Thus, providing the light emitting fan 10/10A with different direction illumination. The locking assembly 232, disposed on the first light guide ring 23, and the receiving assembly 222, disposed on the second light guide ring 22 or the fan frame 21, enable the first light guide ring 23 to lock to the second light guide ring 22 or the fan frame 21, via a pushing force. When the fan assembly 300 is rotatably disposed on the bottom plate 215, the light emitting fan 10/10A of the present disclosure is assembled via assembly of the first light guide ring 23, the light emitting assembly 40, the fan frame 21 and the second light guide ring 22 or inner annular side plate 211 and the plurality of fixing assemblies 232, 222. Thus, assembly time is simplified and saved, and maintenance, repair, and parts replacement are convenient and efficient.

Therefore, embodiments disclosed herein are well adapted to attain the ends and advantages mentioned as well as those that are inherent therein. The particular embodiments disclosed above are illustrative only, as the embodiments disclosed may be modified and practiced in different but equivalent manners apparent to those of ordinary skill in the relevant art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some number. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

The invention claimed is:

1. A light emitting fan, comprising:

a fan frame including a bottom plate, an inner annular side plate, an outer fan frame, and a plurality of anti-vibration mounts, the inner annular side plate coupled to the bottom plate along an inner circumferential edge of the inner annular side plate, the inner annular side plate disposed between the bottom plate and the outer fan frame, each plurality of anti-vibration mounts extends from respective opposing corners of the outer fan frame, each plurality of anti-vibration mounts includes a through hole cut out, the inner annular side plate defines a fan space;

a fan assembly rotatably disposed on the bottom plate and in the fan space;

a first light guide ring including a first annular mount surface and a first annular illumination surface;

a second light guide ring including a second annular mount surface and a second annular illumination surface, the second annular mount surface disposed abutting the first annular mount surface, the first light guide ring and the second light guide ring are disposed between the inner annular side plate and the outer fan frame;

a light emitting assembly disposed between the first light guide ring and the outer fan frame and between the second light guide ring and the outer fan frame, the light emitting assembly configured to emit light through the first annular illumination surface and the second annular illumination surface; and a plurality of fixing assemblies, each plurality of fixing assemblies includes a locking assembly and a receiving assembly, the locking assembly disposed on the first light guide ring, the receiving assembly disposed on at least one of the second light guide ring or the fan frame, wherein the plurality of fixing assemblies is configured to enable the first light guide ring to lock to at least one of the second light guide ring or the fan frame, through the through hole cut out, via a pushing force.

2. The light emitting fan of claim 1, wherein the locking assembly comprises a first base, a deflection part, and a first retaining part, the deflection part protruding from the first base, the first retaining part protruding from an end of the deflection part opposite an end protruding from the first base, and wherein the receiving assembly comprises a second base and a receiving part, the receiving part protruding from the second base, the receiving part including a locking cavity, wherein when the first light guide ring is locked to at least one of the second light guide ring or the fan frame, the first retaining part is disposed in the locking cavity abutting the receiving part.

3. The light emitting fan of claim 2, wherein the first base comprises a first outer side and a first access cut out, the first outer side opposite a side with the deflection part, the first access cut out configured to access the deflection part from the first outer side.

4. The light emitting fan of claim 2, wherein the second base comprises a second outer side and a second access cut out, the second outer side opposite a side with the receiving part, the second access cut out configured to access the first retaining part from the second outer side.

5. The light emitting fan of claim 2, wherein each plurality of anti-vibration mounts further comprises a first depression on a first side and a second depression on a second side, the second side facing a direction that is opposite a direction the first side is facing, the first depression comprises a pair of first opposing positioners, the pair of first opposing positioners protruding in the first depression, the second depression comprises a pair of second opposing positioners, the pair of second opposing positioners protruding in the second depression, a first opening of the through hole cut out is between the pair of first opposing positioners, a second opening of the through hole cut out is between the pair of second opposing positioners.

6. The light emitting fan of claim 5, wherein each plurality of anti-vibration mounts further comprises a through hole, the through hole configured to enable fasteners to be fastened therethrough for mounting of the light emitting fan, the through hole cut out between the through hole and the outer fan frame, the through hole comprising a first protruding part and a second protruding part, a first height of the first protruding part is greater than a depth of the first depression, a second height of the second protruding part is greater than a depth of the second depression.

7. The light emitting fan as claimed in claim 6, wherein the first base comprises a pair of first opposing positioner cut outs and a first protruding part cut out, the first base disposed in the first depression and abutting the pair of first opposing positioner cut outs and the first protruding part, and wherein the second base comprise a pair of second opposing positioner cut outs and a second protruding part cut out, the second base disposed in the second depression and abutting the pair of first opposing positioner cut outs and the first protruding part.

8. The light emitting fan as claimed in claim 6, further comprising a plurality of first elastic covers and a plurality of second elastic covers, each plurality of first elastic covers disposed in the first depression and abutting the first protruding part, each plurality of first elastic covers is configured to cover the locking assembly and the pair of first opposing positioners, each plurality of second elastic covers disposed in the second depression and abutting the second protruding part, each plurality of second elastic covers configured to cover the receiving assembly and the pair of second opposing positioners.

9. The light emitting fan as claimed in claim 8, wherein each plurality of first elastic covers includes opaque material, and wherein each plurality of second elastic covers includes opaque material.

10. The light emitting fan of claim 1, wherein the bottom plate includes a shaft support and the fan assembly includes a hub, a shaft, and a plurality of blades, the shaft support disposed at a center of the bottom plate, the shaft extending centrally from the hub, the plurality of blades radially extending from the hub, the fan assembly disposed on the bottom plate via the shaft and shaft support.

11. The light emitting fan as claimed in claim 1, wherein the light emitting assembly and the outer fan frame define a cavity, and wherein the light emitting assembly includes a circuit board and a plurality of light sources, the plurality of light sources disposed on the circuit board and configured to emit light that is directed toward the first annular illumination surface and directed toward the second annular illumination surface via the cavity.

12. The light emitting fan as claimed in claim 11, wherein when the receiving assembly is disposed on the second light guide ring, the fan frame further includes a plurality of mount stops and the second light guide ring further includes a plurality of mount slots, the inner annular side plate coupled to the outer fan frame via the plurality of mount stops, the inner annular side plate and the outer fan frame define a mounting space, each plurality of mount slots of the second light guide ring abut each plurality of mount stops.

13. The light emitting fan as claimed in claim 12, wherein the first light guide ring further includes an inner annular ledge and a first inner annular sidewall, the inner annular ledge disposed between the first annular illumination surface and the first annular mount surface, the first inner annular sidewall between the inner annular ledge and the first annular mount surface, the inner annular ledge abutting a plate mounting surface of the inner annular side plate, the first inner annular sidewall abutting an outer wall of the inner annular side plate.

14. The light emitting fan as claimed in claim 11, wherein when the receiving assembly is disposed on the fan frame, the second annular mount surface disposed abutting the first annular mount surface are integrally connected and form a second annular side plate, the second annular side plate comprises an inner surface and an outer surface, and wherein the inner annular side plate comprises a plurality of second retaining parts and the second annular side plate comprises a plurality of second receiving through holes disposed through the inner surface, the inner annular side plate coupled to the outer fan frame via the plurality of second retaining parts disposed through the plurality of second receiving through holes and the plurality of fixing assemblies.

15. The light emitting fan as claimed in claim 14, wherein the circuit board is disposed abutting the outer surface, the plurality of light sources between the first annular illumination surface and the second annular illumination surface.

16. A light emitting fan, comprising:

a fan frame including a bottom plate, an inner annular side plate, an outer fan frame, and a plurality of anti-vibration mounts, the inner annular side plate coupled to the bottom plate along an inner circumferential edge of the inner annular side plate, the inner annular side plate disposed between the bottom plate and the outer fan frame, each plurality of anti-vibration mounts extends from respective opposing corners of the outer fan frame, each plurality of anti-vibration mounts includes a through hole cut out, the inner annular side plate defines a fan space;

a fan assembly rotatably disposed on the bottom plate and in the fan space;

a first light guide ring including a first annular mount surface and a first annular illumination surface;

a second light guide ring including a second annular mount surface and a second annular illumination surface, the second annular mount surface disposed abutting the first annular mount surface, the first light guide ring and the second light guide ring are disposed between the inner annular side plate and the outer fan frame;

a light emitting assembly disposed between the first light guide ring and the outer fan frame and between the second light guide ring and the outer fan frame, the light emitting assembly configured to emit light through the first annular illumination surface and the second annular illumination surface; and a plurality of fixing assemblies, each plurality of fixing assemblies includes a locking assembly and a receiving assembly, the locking assembly disposed on the first light guide ring, the receiving assembly disposed on at least one of the second light guide ring or the fan frame, wherein the plurality of fixing assemblies is configured to enable the first light guide ring to lock to at least one of the second light guide ring or the fan frame, through the through hole cut out, via a pushing force; and wherein each plurality of anti-vibration mounts further comprises a first depression on a first side and a second depression on a second side, the second side facing a direction that is opposite a direction the first side is facing, the first depression comprises a pair of first opposing positioners, the pair of first opposing positioners protruding in the first depression, the second depression comprises a pair of second opposing positioners, the pair of second opposing positioners protruding in the second depression, a first opening of the through hole cut out is between the pair of first opposing positioners, a second opening of the through hole cut out is between the pair of second opposing positioners.

17. The light emitting fan of claim 16, wherein each plurality of anti-vibration mounts further comprises a through hole, the through hole configured to enable fasteners to be fastened therethrough for mounting of the light emitting fan, the through hole cut out between the through hole and the outer fan frame, the through hole comprising a first protruding part and a second protruding part, a first height of the first protruding part is greater than a depth of the first depression, a second height of the second protruding part is greater than a depth of the second depression.

18. The light emitting fan as claimed in claim 17, wherein the first base comprises a pair of first opposing positioner cut outs and a first protruding part cut out, the first base disposed in the first depression and abutting the pair of first opposing positioner cut outs and the first protruding part, and wherein the second base comprise a pair of second opposing positioner cut outs and a second protruding part cut out, the second base disposed in the second depression and abutting the pair of first opposing positioner cut outs and the first protruding part.

19. The light emitting fan as claimed in claim 17, further comprising a plurality of first elastic covers and a plurality of second elastic covers, each plurality of first elastic covers disposed in the first depression and abutting the first protruding part, each plurality of first elastic covers is configured to cover the locking assembly and the pair of first opposing positioners, each plurality of second elastic covers disposed in the second depression and abutting the second protruding part, each plurality of second elastic covers configured to cover the receiving assembly and the pair of second opposing positioners.

20. The light emitting fan as claimed in claim 19, wherein each plurality of first elastic covers includes opaque material, and wherein each plurality of second elastic covers includes opaque material.

* * * * *